US008800411B2

(12) United States Patent
Seemangal

(10) Patent No.: US 8,800,411 B2
(45) Date of Patent: Aug. 12, 2014

(54) MULTI-PURPOSE ELECTRICAL PLIER AND STRIKING TOOL

(76) Inventor: Maighbarran Seemangal, Bronx, NY (US)

( * ) Notice: Subject to any disclaimer, the term of this patent is extended or adjusted under 35 U.S.C. 154(b) by 253 days.

(21) Appl. No.: 13/478,224

(22) Filed: May 23, 2012

(65) Prior Publication Data

US 2012/0304393 A1 Dec. 6, 2012

Related U.S. Application Data

(60) Provisional application No. 61/491,419, filed on May 31, 2011.

(51) Int. Cl.
*B25B 7/22* (2006.01)
*B25F 1/00* (2006.01)

(52) U.S. Cl.
CPC .. *B25F 1/006* (2013.01); *B25B 7/22* (2013.01)
USPC ..... 81/420; 7/107; 7/137

(58) Field of Classification Search
USPC ..... 81/420; 7/107, 125, 127, 129–134, 137
See application file for complete search history.

(56) References Cited

U.S. PATENT DOCUMENTS

| | | | | | |
|---|---|---|---|---|---|
| 724,669 | A * | 4/1903 | Cottrell | 7/117 |
| 886,202 | A * | 4/1908 | Grasser | 7/134 |
| 929,821 | A * | 8/1909 | Bonner | 7/131 |
| 3,525,107 | A * | 8/1970 | Hays | 7/107 |
| 3,654,647 | A | 4/1972 | Neff | |
| 3,947,905 | A | 4/1976 | Neff | |
| 4,953,248 | A | 9/1990 | Trombetta | |
| 5,280,659 | A * | 1/1994 | Park | 7/128 |
| D356,238 | S * | 3/1995 | Moore et al. | D8/52 |
| 5,575,029 | A * | 11/1996 | Simpson | 7/137 |
| 6,029,297 | A | 2/2000 | French | |
| 6,223,373 | B1 * | 5/2001 | Yeh | 7/127 |
| 6,493,892 | B2 * | 12/2002 | Kang | 7/137 |
| 8,001,640 | B2 * | 8/2011 | Carter | 7/132 |
| 2005/0188468 | A1 | 9/2005 | Crawford | |

* cited by examiner

*Primary Examiner* — David B Thomas
(74) *Attorney, Agent, or Firm* — Daniel Boudwin; Global Intellectual Property Agency LLC

(57) ABSTRACT

A multipurpose electrician's tool is disclosed having a plurality of fabrication and installation features. The device comprises a plier tool having a first and second member connected at a pivot point, including a wiring stripping section, a shearing section, a cutting section, a gripping section, a wire bending section and a hammer head section. The wire stripping section allows insulated wire to be stripped to expose bare wire; the shearing section comprises an alignable set of apertures for tailoring a screw length by a shearing action of the two members; the cutting section comprises a pair of adjoinable cutting surfaces; the gripping section is positioned at the distal end of the plier members for compressing items therebetween; the wire bending section allows for wire ends to be formed for solderless connections; and finally the hammer head section comprises a pair of impact surfaces for driving nails or striking a target.

3 Claims, 2 Drawing Sheets

MULTI-PURPOSE ELECTRICAL PLIER AND STRIKING TOOL

CROSS REFERENCE TO RELATED APPLICATION

This application claims the benefit of U.S. Provisional Application No. 61/491,419 filed on May 31, 2011, entitled "Heavy Duty Multi-Purpose Electrical Pliers."

BACKGROUND OF THE INVENTION

1. Field of the Invention

The present invention relates to electrical pliers and electrician's hand tools. More specifically, the present invention relates to a compound electrician's tool having several combined functions for eliminating the need for multiple tools or for successive tool switching between tasks.

Electricians and homeowners utilize several tools during household wiring or electrical installation activities. Generally the art of installing new wire routing, new electrical fixtures or installation electrical assemblies requires a plurality of tools that facilitate installation, fabrication, and electrical and structural assembly modification for the purposes of establishing electrical connectivity. These tools provide a mechanical advantage for operations such as insulated wire stripping, wire cutting, screw cutting and driving, hammering, forming solderless and soldered wire connections, as well as a plurality of other common electrical operations common to household electrical installations. Several tools require an electrician or homeowner to obtain and store several different tools, each of which being particularly suited for their given task. This further requires the user to continually switch tools between different operations, which increases the job time and the hassle of handling several different tool types for a given task, particularly for electrical operations wherein users generally operate in confined or enclosed areas making large tool trays inefficient to handle.

The present invention is a multipurpose electrician's plier tool having a plurality of imbedded functions. The tool comprises a first and second member attached to a common pivot location as commonly known in the art of pliers, a wiring stripping section, a shearing section, a cutting section, a gripping section, a wire bending section and finally a hammer head section. The hammer head section comprises a pair of laterally opposed planar striking surfaces along the working end of the plier members, whereby the tool can be utilized to drive or strike an object as would be customary with a hammer tool. The remaining sections include electrician tools that facilitate electrical assembly installation and electrical wire manipulation or fabrication.

2. Description of the Prior Art

Several multipurpose and compound tools have been disclosed in the art that relate to electrician hand tools for improving efficiency and reducing overall tool count for a given task requiring different operations. These tools have familiar design elements for the purpose of combining several functions into a singular tool, whereby tool count and tool switching is reduced. Devices of this type have been patented or disclosed in published patent applications. The patents deemed most relevant to the present disclosure are described below, whereby their key elements are discussed for the purposes of differentiating the present invention.

Specifically, U.S. Pat. No. 6,029,297 to French is one such device that describes a multi-purpose electrician plier tool having a first and second pivotal member secured via a pivot pin connection. The pliers comprise several features that facilitate different electrician functions and fabrication features in a single tool. The tool includes planar wire splicing faces, wire cutter portions, wire crimping portions, a wire stripper portion, a fish tape engaging portion for gripping fish tape therebetween, and finally a pair of wire curl holes for forming terminal ends of bare wire. The handle portion of the device includes a pair of arcuate members in opposition to one another that allow the user to facilitate the different fabrication and modification functions of the tool using one hand. The French device describes a multi-function tool having several integral features for the purposes of improving electrician efficiency; however this device fails to include screw cutters and a hammer surface thereon, which are two common electrician functions that would otherwise require separate tools.

U.S. Pat. No. 3,654,647 to Neff is another device that discloses a combination wire working hand tool for electrical wiring that combines gripping, pulling, cutting, stripping and crimping operations into a single tool. The tool comprises a needle-nose plier jaws that includes a solderless electrical terminal crimping orifice, cutter blades, and a plurality of stripping orifices for stripping insulated wires. The Neff device provides an electrician's hand tool having several features that facilitate fabrication and installation of electrical installations. However, no hammering surface or screw cutting orifices are provided. The structure and tasks for which the present invention are directed diverge from the Neff device, wherein the Neff device is a needle-nose plier assembly having differing elements.

Similarly, U.S. Pat. No. 3,947,905 also to Neff describes a multi-purpose hand tool that combines gripping, pulling, bending, cutting, stripping, crimping and shearing operations into a single tool. The '905 Neff device provides a needle-nose plier configuration that includes alignable fastener shearing orifices that allow for trimming fastener lengths, an arcuate inner crimping portion, wire stripping orifices, a wire cutting portion and finally a gripping distal portion. Similar to the '647 Neff device, the '905 Neff device employs a plurality of tool operations adapted for use by an electrician or home repair user that reduces overall tool count and switching tools between operations. The present invention provides a similarly featured hand tool, while also including a means to impact an article with a hammer surface. The combination of elements for the present invention, and its unique layout are divergent from the Neff devices, which provide needle-nose pliers having differing functions.

Further, U.S. Published Patent Application Publication No. 2005/0188468 to Crawford discloses multi-functional pliers of similar type to the Neff and French disclosures, wherein the pliers employ a plurality of imbedded tools to facilitate electrical wiring installation and fabrication. These imbedded tools include a wire cutting tool, stripping tool, and a wire bending tool, wherein the tools are provided in several different embodiments. As with the previous prior art devices, no hammering surface is provided or fastener shearing tool, as is provided in the present invention.

Finally, U.S. Pat. No. 4,953,248 Trombetta discloses an electrician hand tool having a first and second member pivotally connect to one another at a common pivot location. The tool combines cutter blades for cutting and stripping electrical wiring, along with an outwardly transverse extension terminating in a hammer head extending laterally from the handle portion of the tool. Opposite of the hammer head is an extension having a pivotable knife blade for opening packaging, general cutting and plastic sheath cutting. The hammer head of the Trombetta device extends outwardly from the plier tool forming a hammer neck, poll and hammer face of a traditional hammer head. This creates considerable weight along one side of the tool, wherein the hammer head is comprised of a dense or hardened material adapted for striking an article. The present invention provides a hammering surface along its lateral sides; however the present invention does not offset the weight of the overall tool to achieve this end. The hammering surface is one of hardened and planar material that is particularly suited for controlled strikes against a nail or similar article adapted to receive the impact energy. The present invention provides a more compact and efficient hammering surface without compromising the weight distribution of the tool or its aesthetics, wherein the Trombetta device may suffer from clearance and handling issues in tight spaces due to its oversized and outwardly projecting working end.

The present invention provides a combination hammer tool and electrician utility tool, whereby striking functions and electrical installation functions can be accomplished utilizing a single tool. This allows a user to utilize the tool as both a striking tool and electrician's plier without tool switching or carrying extra tools to a job site. The hammer head section comprises two laterally opposed strike faces having a hardened segment of material and additional mass to facilitate striking with the plier tool in confined spaces and without utilizing a much larger and more cumbersome hammer tool. The positioning of the hammer strike faces does not upset the lateral weight balance of the tool or overly extend one side, which allows the tool to remain compact for entering more confined areas and improving user handling of the device. The structure and combination of a hammer strike surface with an electrician's utility plier tool is substantially divergent in design elements from the prior art, and consequently it is clear that there is a need in the art for an improvement to existing multipurpose electrician plier tool devices. In this regard the instant invention substantially fulfills these needs.

SUMMARY OF THE INVENTION

In view of the foregoing disadvantages inherent in the known types of multipurpose electrician plier tool devices now present in the prior art, the present invention provides a new multipurpose tool wherein the same can be utilized for providing convenience for the user when enabling a user to hammer an article and manipulate electrical assemblies using a single tool.

It is therefore an object of the present invention to provide a new and improved multipurpose electrician plier tool device that has all of the advantages of the prior art and none of the disadvantages.

It is another object of the present invention to provide a multipurpose tool having electrical plier functions combined with a hammer tool capabilities, allowing a user to engage in several electrical fabrication and installation tasks while providing a hammer tool for striking or driving an object in confined areas.

Another object of the present invention is to provide a multipurpose tool having a hammer head portion comprising a pair of strike faces laterally opposed to one another about the plier member working end so as not to alter the laterally-centralized weight distribution of the tool, while providing a pair of hardened strike faces adapted to transmit considerable strike energy onto a target object.

Yet another object of the present invention is to provide a multipurpose tool having a plurality of electrical installation capabilities, including wire stripping, fastener shearing, wire cutting, gripping, and wire bending.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
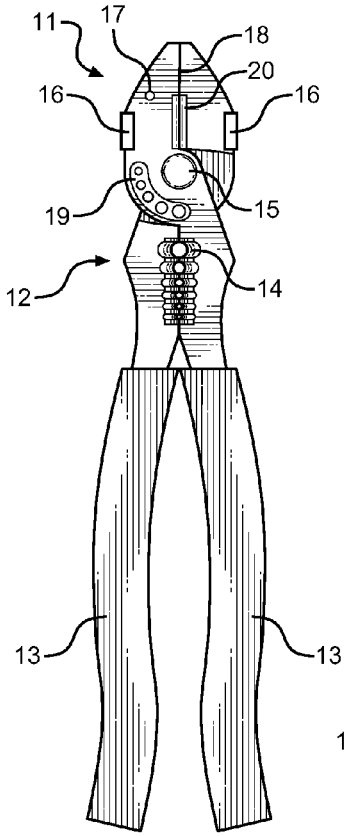
FIG. 1 shows a bottom view of the present multipurpose tool.
Figure 2:
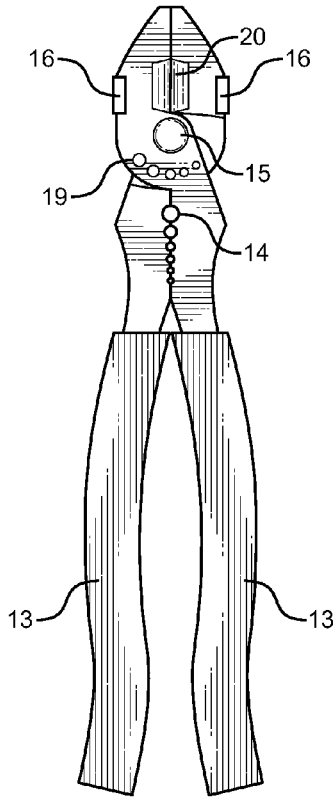
FIG. 2 shows a top view of the present multipurpose tool.

Reference is made herein to the attached drawings. Like reference numerals are used throughout the drawings to depict like or similar elements of the multipurpose electrician plier tool. For the purposes of presenting a brief and clear description of the present invention, the preferred embodiment will be discussed as used for providing a user with a singular tool that facilitates electrical installation operations and hammering capabilities. The figures are intended for representative purposes only and should not be considered to be limiting in any respect.

Referring now to FIGS. 1 through 5, there are shown various views of the present multipurpose tool of the present invention. The tool combines several features that are commonly seen in electrical pliers and hammer tools for the purpose of reducing tool count and tool switching while installation or fabricating an electrical installation. The tool comprises a first and second member 13 which are rotatably connected at a common pivot point 15 as is well known in the art of plier tools. The members 13 form arcuate gripping handles on one end of the pivot point, and a pair of clamping jaws on the second end of the pivot point, which forms the tool working end 11. Above the handle grips is a central region 12 that includes a wire stripping section 14. The wire stripping section 14 comprises a plurality of apertures formed by the contact points between the first and second member, whereby the apertures are varying sized holes through which insulated wire is placed. The apertures form cutting surfaces about their inner race to cut through the insulation up to the bare wire, whereby the insulation is severed and can be removed to expose bare wire necessary to establish electrical connectivity. This section 14 design and placement is common in the art of wire stripping tools, and should be readily recognizable to one skilled in the art. The apertures have tapered inner walls that converge into a cutting surface revolving around the formed aperture on the front side of the tool, which allows discrete cuts to be made along the wire for removal of insulation.

Just above the wire stripping section 14 and just below the pivot point 15 is the screw shearing section 19. The shearing section 19 comprises a plurality of apertures that are aligned along a common radial path about the pivot point 15. The apertures are present on both the first and second member and comprise diameters that are equal to common fastener diameters. The aperture sizes are aligned from smallest to largest and are in opposite order on the first and section member, whereby proper alignment of the same aperture size requires the plier members to be expanded a given distance, which is the setup for the shearing operation. The inner walls of the apertures are threaded to allow a screw to be inserted into the aligned apertures up to the distance desired for shortening the given screw. Once inserted through the aligned apertures, the plier members can be compressed together to shear the end of the screw without damaging its distal threads. This shortens the length of the screw by a desired distance, which is desired when overly long screws are supplied for installations requiring only a short length of threading for proper engagement and torquing. Similar to the wire stripping section 14, the screw shearing section 19 is a common tool that is readily recognized by one skilled in the art of shearing and plier tools.

Figure 3:
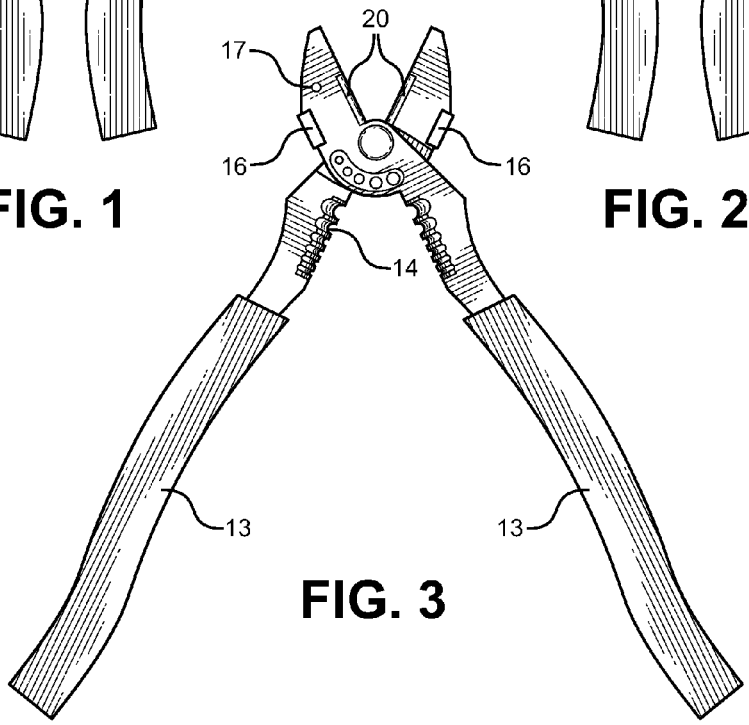
FIG. 3 shows a bottom view of the present multipurpose tool in an open configuration.
Figure 4:
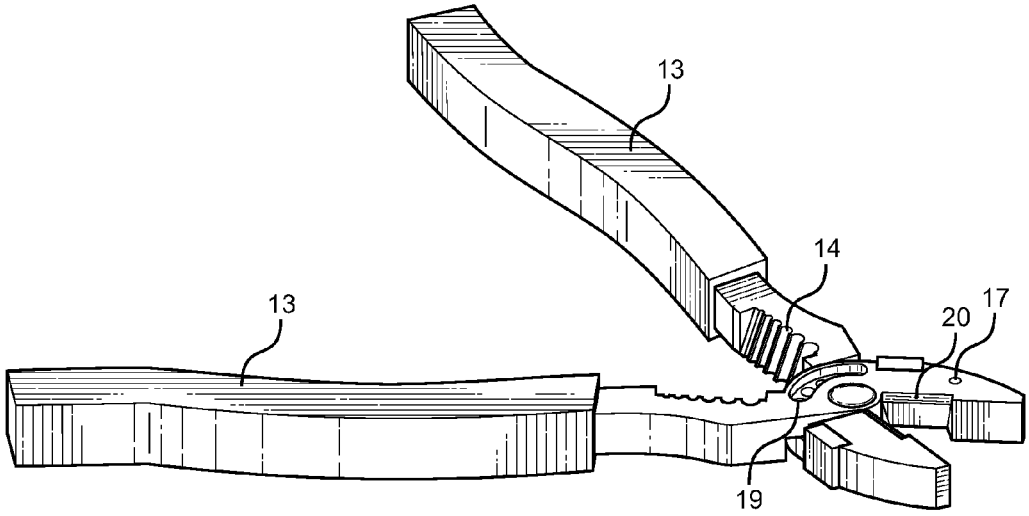
FIG. 4 shows a perspective view of the present multipurpose tool in an open configuration.
Figure 5:
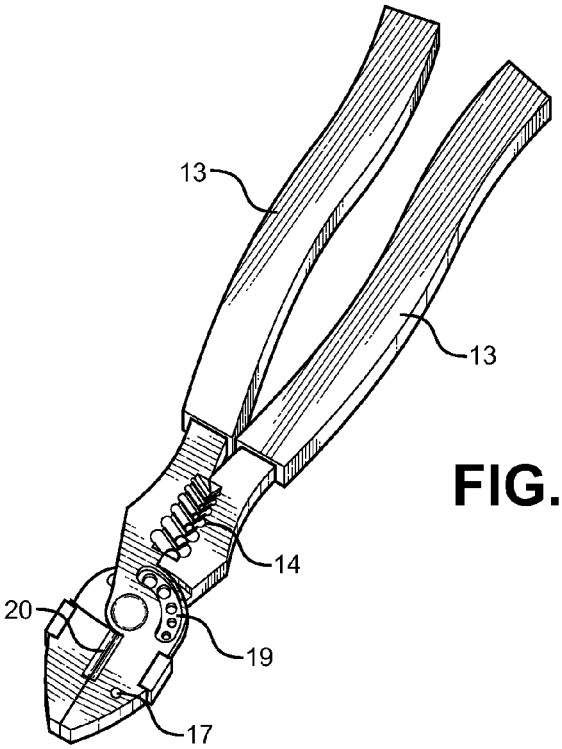
FIG. 5 shows a perspective view of the present multipurpose tool in a closed configuration.

Referring now to FIG. 3, there is shown the working end of the multipurpose plier tool in an open configuration. The distal end of the pivotable members is formed of a first and second separable jaw that is commonly found in most plier tools. The jaws facilitate grasping and compressing articles therebetween, wherein the handles are compressed together on the opposite side of the pivot point 15 or released to open the pair of jaws. This allows users to manipulate wires with a mechanical advantage or compress electrical crimp connectors. The jaws form the gripping section of the present tool, while the inward and interior portion of each jaw forms the wire cutting section 20. The wire cutting section 20 comprises a pair of alignable cutting surfaces that allow a user to compress a wire therebetween for the purpose of making a through-cut to adjust the length of a given wire. This section is further well recognized in the art of wire cutting and electrical plier tools for the purpose of cutting electrical wire.

Adjacent to the cutting section 20 and through one of the plier jaws is an aperture 17 that comprises the wire bending section. This aperture 17 is adapted to accept a wire therethrough, whereafter the elongated section of the wire outside of the aperture can be bent around the outer surface of the plier jaw. This allows a user to produce a curl or arcuate termination along a wire, which is necessary for solderless electrical connections that are formed by compressing the bare wire against a contact plate using a screw fitting terminal. This forms an electrical connection, while the curled end of the wire forms around the terminal for improved surface connectivity therealong. Similar to the aforementioned elements, the wire bending section is one that is known in the art of electrical tools for bending wire ends to form solderless electrical connections.

Moving outward from the cutting section 20 and positioned on the exterior sides of the first and second jaw member are a first and second hammer strike surface 16. These surfaces comprise the hammer head section of the present invention, which is provided to allow a user to utilize the plier device as a striking or driving tool. The striking surfaces 16 are laterally opposed to one another along the tool working end 11, and are comprised of raised, hardened and planar surfaces that are adapted to provide a hard striking location for driving nails or striking a target and imparting an impact load therethrough. It is commonplace for a user to find a situation in which a nail must be driven in a situation or location in which a traditional hammer is not readily available or able to reach a confined location. The user generally uses any flat surface on the tool to strike the nail for driving purposes. However, this can damage the tool or be a relatively method of driving the nail depending on the design of the tool and the surface utilized for striking. The present striking surfaces 16 are enlarged, planar surfaces of hardened material that add weight to the working end 11 of the tool and a larger surface for which to impact the head of a nail. Their sizes are equal on the lateral sides of the tool to maintain the centralized lateral center of gravity of the tool, as opposed to other hammer tools that offer offset hammer heads that change the inertia of the tool. The striking surfaces 16 of the present invention are of equal size and shape, but are also not overly large so as to limit the tool's effectiveness in confined spaces. In practice, the user swings the working end of the tool towards a nail head, utilizing the strike faces 16 as an impact location for which to drive the nail into its target medium. The weighted material adds mass to the working end of the tool for increased driving energy, while the hardened surface resists surface deformation during the impact.

The user end of the rotatable members 13 are elongated and arcuate lengths that form handles, which may be covered by elastomeric or comfort hand grips for the user to grasp during operation of the tool. The operable sections of the tool are bare metal surfaces, which combine to form a multi-functional and multipurpose plier tool that brings together electrical plier features and a hammer striking capability. Completing electrical work often requires the use of several different tools, as many different tasks are generally necessary to complete an electrical fixture installation or wiring project. Electricians may be required to carry around one tool for each task, which can be cumbersome and unnecessary. When a different tool is needed for a new task, the user must search and acquire the necessary tool, adding time and inefficiencies to the overall project. If the necessary tool cannot be immediately located, the corresponding task may not be completed, further extending the completion of the project at hand.

The present invention is designed to assist users in completing a variety of tasks using a single tool to accomplish multiple operations. The device comprises a plier tool in combination with a striking tool, wherein the plier tool is specifically adapted for use with electrical installation and fabrication. The device allows users to complete a variety of tasks using one tool, including gripping, wire stripping, screw shearing, wire stripping, wire curling and finally hammering operations. While many combination tools exist in the prior art related to electrician tools, the present invention is disclosed having novel hammering surfaces in conjunction with a plier tool having electrical fabrication features.

In light of the prior art and the given disclosure, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multipurpose plier tool and striking device, comprising:

a first and second elongated member pivotably connected about a common pivot point, said member forming an elongated handle region and a central region on a first side of said pivot point, and a working end on a second side of said pivot point;

said handle region comprising a first and second elongated and arcuate user handle grip;

said central region comprising a wire striping section and a screw shearing section;

said working end comprising a first and second plier jaw comprising a plier gripping section, a wire cutting section and a hammer head section;

said jaws adapted to spread when said handle members are spread, and compress together when said handle members are compressed together;

said hammer head section comprising a first and second hardened and planar striking surface laterally opposed on said jaws.

2. The device of claim 1, wherein said first and second hammer head section further comprises equally weighted sections along said jaws to maintain a centralized lateral center of gravity.

3. The device of claim 1, wherein said first and second hammer head section further comprises raised striking surfaces laterally protruding from said jaws.

* * * * *